US005819805A

United States Patent [19]

Mosing et al.

[11] Patent Number: 5,819,805

[45] Date of Patent: Oct. 13, 1998

[54] CASING THREAD PROTECTOR

[75] Inventors: Donald E. Mosing; Charles Sodha, both of Lafayette, La.

[73] Assignee: Frank's Casing Crew & Rental Tools, Inc., Lafayette, La.

[21] Appl. No.: 580,961

[22] Filed: Apr. 12, 1996

Related U.S. Application Data

[63] Continuation-in-part of Ser. No. 215,696, Mar. 22, 1994, Pat. No. 5,524,672.

[51] Int. Cl.[6] ..... F16L 57/00

[52] U.S. Cl. ..... 138/96 T; 138/110

[58] Field of Search ..... 138/96 T, 96 R, 138/110, 99; 166/243; 215/329, 275, 43

[56] References Cited

U.S. PATENT DOCUMENTS

| | | | |
|---|---|---|---|
| 1,349,789 | 8/1920 | Schirra . | |
| 1,756,167 | 4/1930 | Avery | 138/96 T |
| 2,175,414 | 10/1939 | Stevenson | 138/96 T |
| 2,196,454 | 4/1940 | Kahn et al. | 138/96 T |
| 2,880,761 | 4/1959 | Peter | 138/96 T |
| 3,028,182 | 4/1962 | Brown | 166/243 |
| 3,038,502 | 6/1962 | Hauk et al. | 138/96 T |
| 3,858,613 | 1/1975 | Musslewhite | 138/96 T |
| 4,233,469 | 11/1980 | Steppe | 138/96 T |
| 4,318,426 | 3/1982 | Callanan et al. | 138/967 |
| 4,354,529 | 10/1982 | Soutsos et al. | 138/96 T |
| 4,484,785 | 11/1984 | Jackson | 138/110 |
| 4,616,679 | 10/1986 | Benton | 138/96 R |
| 4,697,830 | 10/1987 | Wood et al. | 138/96 T |
| 4,889,167 | 12/1989 | Morris | 138/96 T |
| 5,288,108 | 2/1994 | Eskew et al. | 138/96 T |
| 5,368,074 | 11/1994 | Hall | 138/96 T |

FOREIGN PATENT DOCUMENTS

| | | |
|---|---|---|
| 757447 | 5/1955 | United Kingdom . |
| 1579154 | 6/1977 | United Kingdom . |
| 2038273 | 7/1980 | United Kingdom . |

*Primary Examiner*—Denise L. Ferensic
*Assistant Examiner*—James F. Hook
*Attorney, Agent, or Firm*—Matthews, Joseph Shaddox & Mason, L.L.P.

[57] ABSTRACT

A new and improved casing thread protector that has a toroidal body of elastomer with a bore to accept a pipe end, thread engagement pads, and a metal band and clamp arrangement extending around its periphery. The bore accepts the end of a pipe with threads to be protected when the thread engagement pads are allowed a certain degree of movement due to the open position of the clamp, which pads subsequently grip the pipe within the bore when the clamp is closed. The pads, which are replaceable, come into contact with the tubular inserted in the bore when the clamp is in the closed position, isolating the tubular good from the body of the improved device and creating greater pressure on the contact points of the threads of the tubular good which increases the force required to dislodge the improved protector from the threads. The band and clamp arrangement may be placed in an open peripheral groove which creates an optional arcuate tunnel partially encircling the outer face of the body member of the new and improved casing thread protector.

15 Claims, 8 Drawing Sheets

CASING THREAD PROTECTOR

This application is a continuation-in-part of patent application U.S. Ser. No. 215,696, filed 22 Mar., 1994, now U.S. Pat. No. 5,524,672, issued 11 Jun., 1996.

FIELD OF THE INVENTION

This invention relates generally to thread protectors for use at the ends of tubular goods, and more particularly to a device for protecting the male threads on the end of well pipe joints.

BACKGROUND

Tubular goods whose use includes, but is not limited to, use in the drilling for oil and gas, experience a considerable amount of handling and certain degree of mishandling and abuse on their journey from the steel mill to the final well destination. As a result, screw on cylindrical thread protectors with a full compliment of threads are placed on such tubular goods to protect the threads from any harm prior to installation. However, because the removal of such protectors often requires an expenditure of time that cannot be tolerated during the installation of tubular strings in wells, the original protector is often removed at the well site and is replaced with a protector with quick release and install capabilities. The tubular good subsequently rides from rack to rig with the new thread protector which is eventually removed when the joint is to be threadedly attached to the downwardly continuing string. During the interval that the protector is on the threads, a last bore drift test is usually done and it is desirable that the protector does not interfere with the drift passage. Once the string is pulled out of the hole, the quick install capabilities of such a thread protector ensure protection for the threads on tubular goods whose threads have not been damaged in the drilling activity.

A considerable amount of development work has been done in efforts to improve the bands and related tensioning gear to keep the casing protectors from being knocked off the threads during the rack to well trip.

The body of protectors in rig site use are currently made of elastomer, usually polyurethane, but may sometimes be made of other material, such as black rubber. The elastomer is formulated and cured to serve the skid and bash protection function and does not always favor thread gripping. In order for the elastomer to adequately grip the threads on the tubular goods to be protected, a sufficient amount of hoop force must be applied, which is often accomplished through the tensioning of bands around the elastomer. However, such securing bands are designed to be tensioned by hand and consequently, seldom have enough energy to drive the elastomer into the thread grooves sufficiently to prevent the occasional slipping of the protector.

Furthermore, the thread protectors in rig site use are currently designed so that the elastomer is pulled apart to accommodate the threads to be protected and subsequently tightened around such threads when the protector is in place. The net effect of repetitive pulling apart is that the elastomer would eventually deform due to the repetitive yielding, causing the elastomer to lose its memory characteristics.

It is therefore an object of this invention to provide an elastomeric thread protector with higher unit loading to more effectively engage the male threads on tubular goods yet allow drift testing of the pipe bore.

It is another object of this invention to provide replaceable elements subject to the higher unit loading to reduce the frequency of total body losses due to thread load induced damage, which facilitate the application of the thread protector on the tubular good to be protected.

It is another object of this invention to provide a tensioning hoop band which causes the thread engagement pads to engage the pipe threads sought to be protected, which pads are readily replaceable when damaged to preserve the elastomeric body.

It is yet another object of this invention to provide an integral molded piece of elastomer which does not undergo any tension causing the elastomer to yield, thereby increasing the life span of the thread protector.

These and other objects, advantages, and features of this invention will be apparent to those skilled in the art from a consideration of this specification, including the attached claims and appended drawings.

SUMMARY OF THE INVENTION

The improved protector has an integral elastomer body of generally toroidal shape common to a donut. The toroid contains several spaced openings which allow for the mounting of thread engagement pads which engage the threads of the tubular good once the band is tightened around the thread engagement pads. This reduces the contact area with the threads being protected and increases unit load. Additionally, the pads do not necessarily have the physical characteristics of the general body and can be devised to optimize the extrusion of elastomer into thread grooves, and can be provided of soft metal or plastic with grooves to engage threads.

BRIEF DESCRIPTION OF DRAWINGS

In the drawings wherein like symbols refer to similar features.

DETAILED DESCRIPTION OF DRAWINGS

Figure 1A:
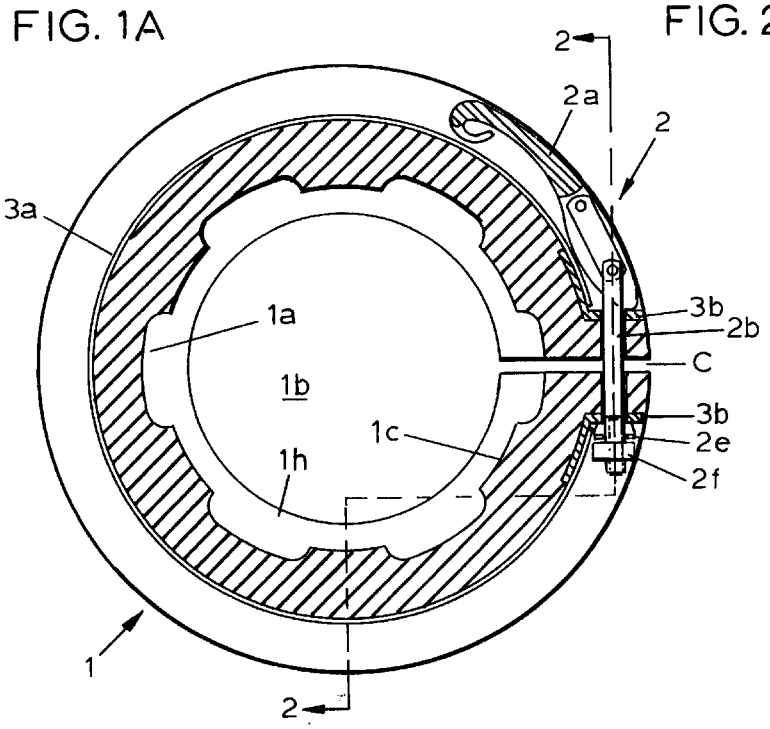
FIG. 1A is an elevation viewed along the axis of the pipe to be protected.
Figure 2:
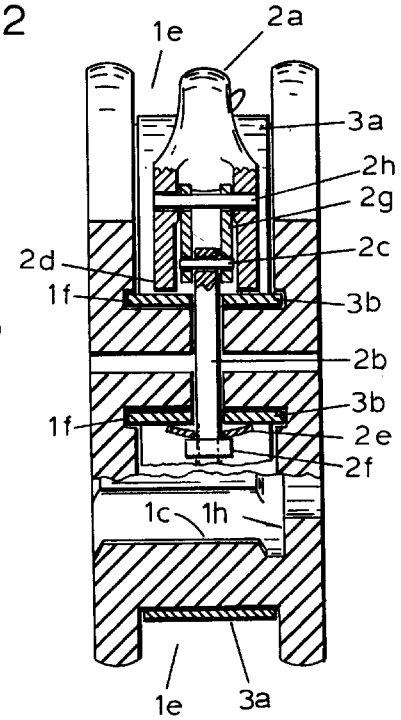
FIG. 2 is a right side view, partly sectioned, of the protector of FIG. 1A.
Figure 1B:
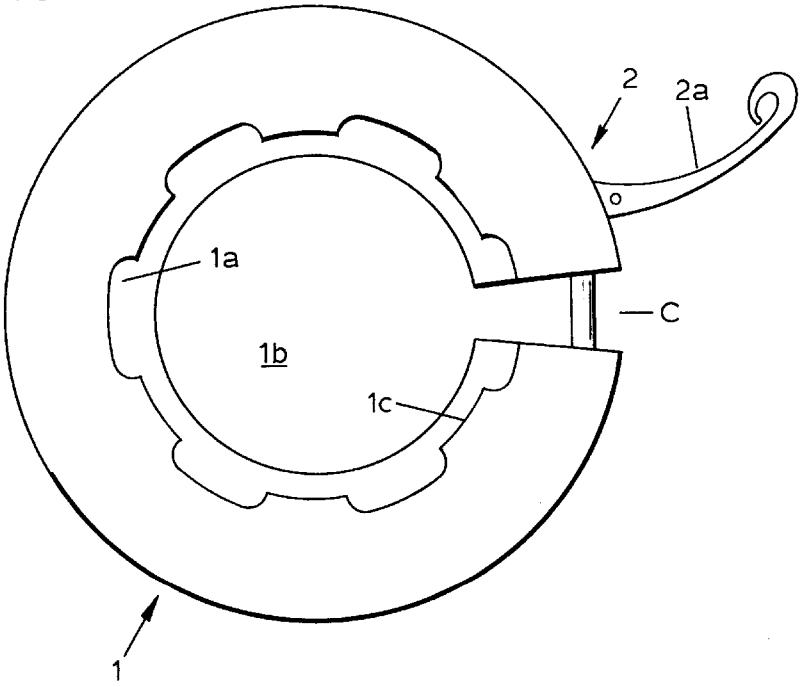
FIG. 1B is an unsectioned view similar to FIG. 1A in the alternate position, open to release pipe.
Figure 3:
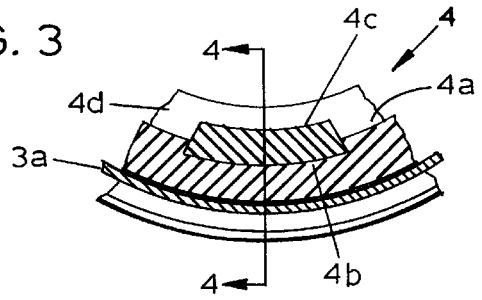
FIG. 3 is a sectional view of a selected area of FIGS. 1A and 2.
Figure 4:
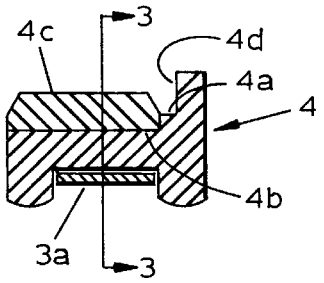
FIG. 4 is a sectional view taken along line 4—4 of FIG. 3.
Figure 5:
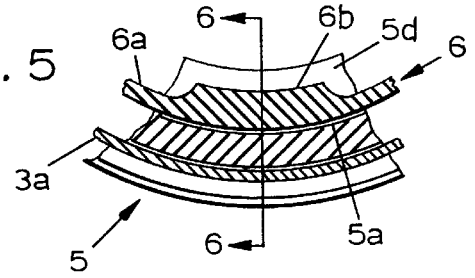
FIG. 5 is a sectional view similar to that of FIG. 3 but showing an alternate for a of one feature of the invention.
Figure 6:
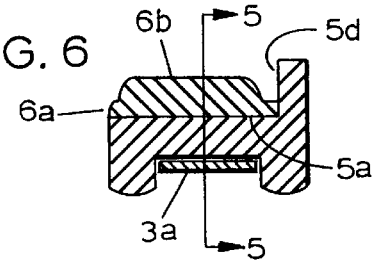
FIG. 6 is a sectional view taken along line 6—6 of FIG. 5.
Figure 7:
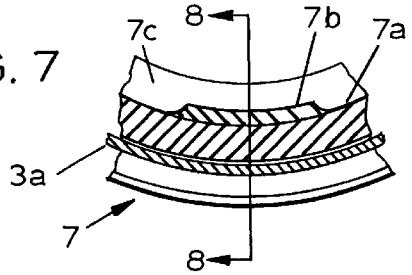
FIG. 7 is a sectional view, similar to that of FIG. 5 of an alternate form of the invention.
Figure 8:
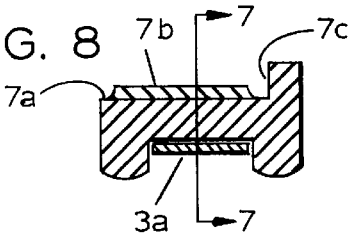
FIG. 8 is a sectional view taken along line 8—8 of FIG. 7.
Figure 10:
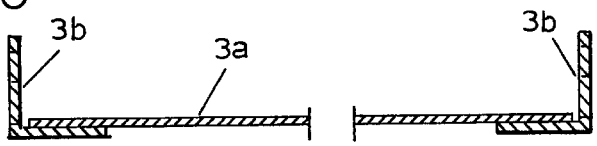
FIG. 10 is a sectional view taken along line 10—10 of FIG. 9.
Figure 11:
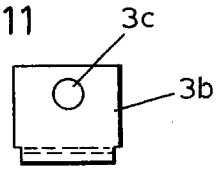
FIG. 11 is a right end view of the component of FIG. 10.
Figure 9:
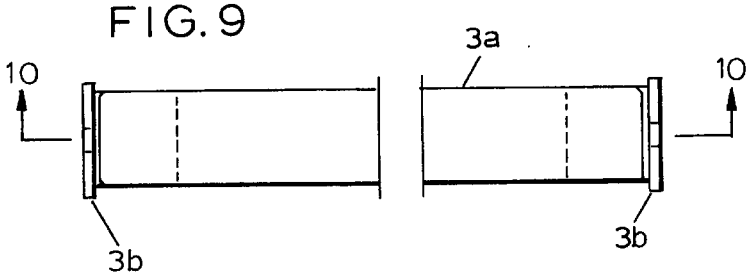
FIG. 9 is an elevation of component common to FIGS. 1A through 12.
Figure 12:
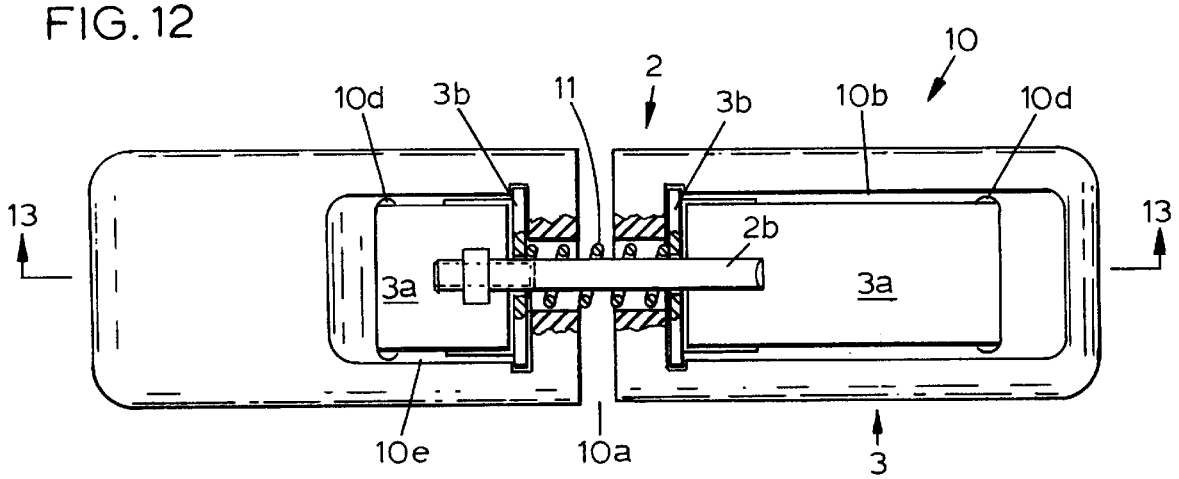
FIG. 12 is an elevated view of an alternate body configuration.
Figure 13:
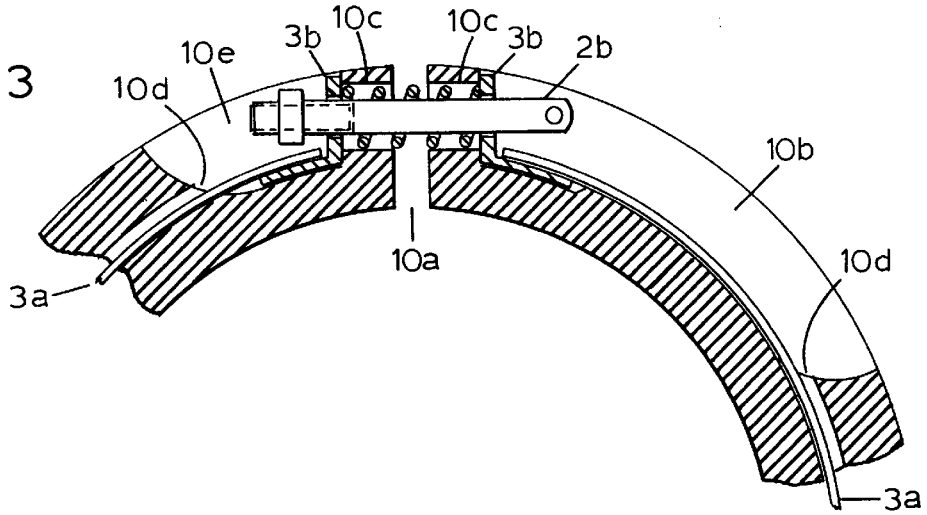
FIG. 13 is a sectional view taken along line 13—13 of FIG. 12.
Figure 14:
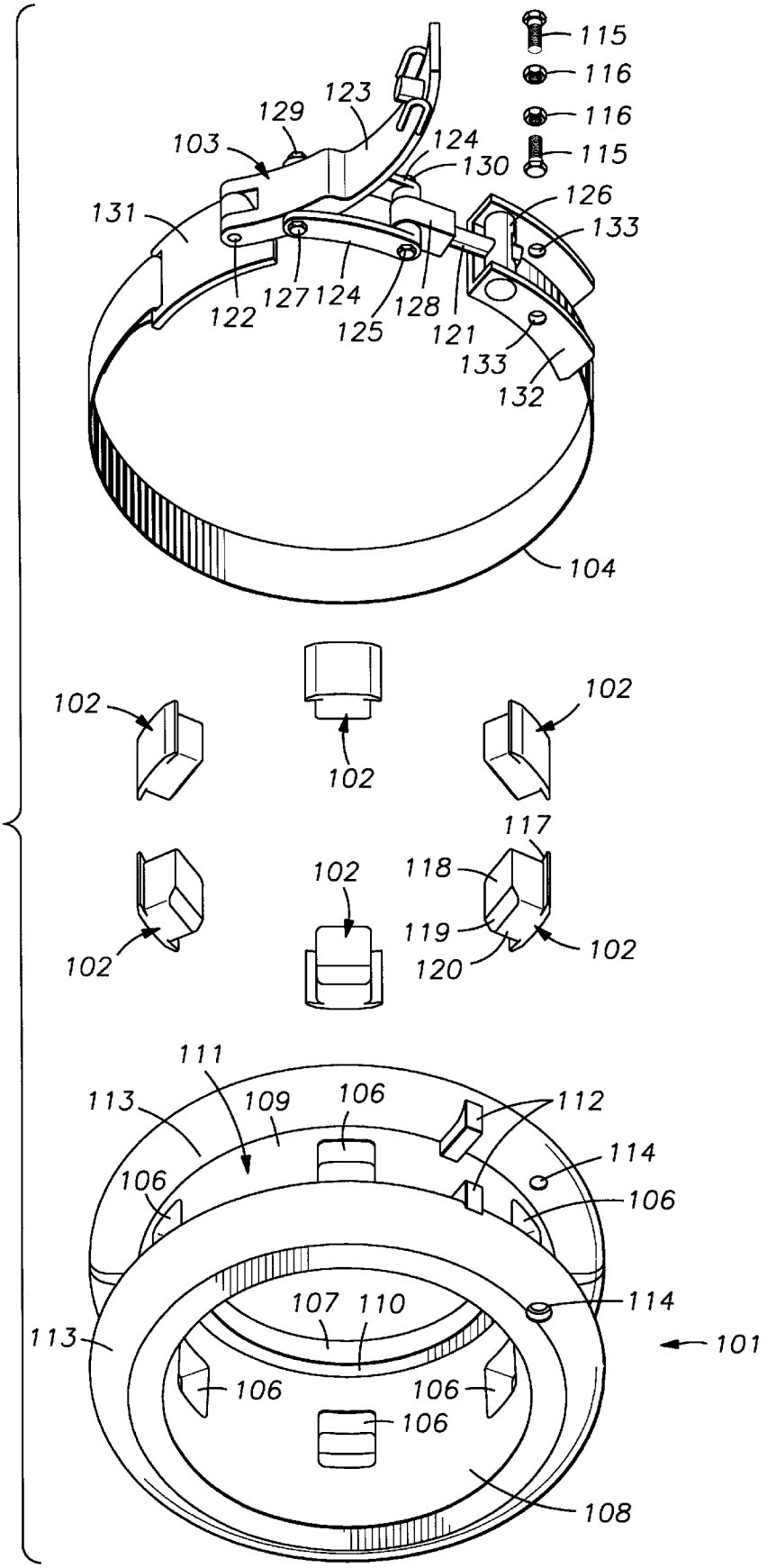
FIG. 14 is an exploded perspective view of the preferred embodiment of the apparatus of the new and improved casing thread protector.

U.S. Pat. No. 5,524,672 to Mosing et al. is incorporated herein by reference. FIG. 14 shows the four main components of the preferred embodiment of the improved device, namely, a donut shaped body 101, thread engagement pads 102, clamp mechanism 103, and a flexible band 104. Donut shaped body 101, which is substantially cylindrical, comprises generally an integral body, which in the preferred embodiment is made of elastomer, with a central bore 107 which is of a diameter marginally larger than that of the casing bore, an outer face 109, an inner face 108 and a plurality of openings 106 spaced around body 101, extending from outer face 109 to inner face 108, and which openings, in the preferred embodiment are equidistantly spaced. In the preferred embodiment of the improved device, flange 110 is an integrally formed flange on the inner face 108 at one end of body 101, which flange serves to stop and position pipe entering bore 107. The preferred embodiment of the improved device also contemplates an optional channel 111 which is formed along the outer face 109 and which extends around the entire perimeter of body 101, forming two parallel channel walls 113 which similarly extend around the entire perimeter of body 101. In the preferred embodiment of the improved device, body 101 has two stops 112 which are of equal dimensions and which are formed into body 101, extending perpendicularly from outer face 109 to the outer edge of channel walls 113, and two holes 114 which are formed in each of the two channel walls 113 and which are aligned so that they are directly opposite each other. Each of the holes 114 in the improved device are designed to accommodate a bolt 115 which is of a length marginally longer than the width of channel walls 113 and which bolts have corresponding nuts 116.

Designed to fit into each of spaced openings 106 of the improved device are thread engagement pads 102 which are comprised mainly of a body 120, which body 120 has a flange 117 designed to prevent body 120 from slipping through opening 106 when thread engagement pad 102 is inserted therein and a face 118 which engages the male threads on the pipe to be protected. In the preferred embodiment of the improved device, any engagement between the improved device and the male threads of the pipe inserted through bore 107 is limited to the contact between said threads and the individual faces 118 of thread engagement pads 102. Further contemplated in the preferred embodiment of the improved device are notches 119 which are cut out of body 120 and which serve to facilitate the insertion of a tubular good into bore 107 when thread engagement pads 102 are inserted into their respective openings 106. When notches 119 are cut out of body 120, body 120 takes on a substantially trapezoidal configuration. It is also contemplated that thread engagement pads 102 may have more than one notch 119 such that said pads may be rotated in their respective holes 106 and still achieve the facilitating function of said notches mentioned above. Furthermore, while the preferred embodiment of the improved device contemplates the shape of body 120 to be substantially that of a rectangular block, the improved device further contemplates other configurations of body 120, including, but not limited to, a square or spherical, which configurations would be obvious to one skilled in the art. Finally, it is contemplated that each thread engagement pad 102 is to be readily and easily replaceable with other similarly shaped or sized thread engagement pads.

FIG. 14 further shows a flexible and removable band member 104, which band is designed to wrap around outer face 109 of the improved device and to attach to each of the two ends of the clamp mechanism 103, which mechanism is comprised primarily of a band plate 131, a clamp lever 123, links 124, and a tensioning bolt 121 bearing upon a pivoting terminal 126 which is housed in band plate 132. Clamp lever 123 pivots about pin 122, and acts upon the two links 124 which are attached to the clamp lever 123 by bolt 127, which bolt is secured by nut 129, and to a housing 128 by bolt 125, which bolt is secured by nut 130. Housing 128 connects links 124 to pivoting terminal 126 when tensioning bolt 121 is inserted through its corresponding hole in terminal 126 and screwed into the female threads contained in housing 128. In the preferred embodiment of the improved device, band plate 132 has two holes 133 which are designed such that each hole 133 lines up with its corresponding hole 114 on body 101 and such that each hole 133, in turn, receives a bolt 115 which serves to secure band plate 132 to body 101 when a nut 116 is applied to each of bolts 115. Further in the preferred embodiment of the improved device, band plate 132 is contemplated to be acted upon by the two stops 112 which prevent band plate 132 from moving toward clamp mechanism 103 of the improved device.

Figure 15:
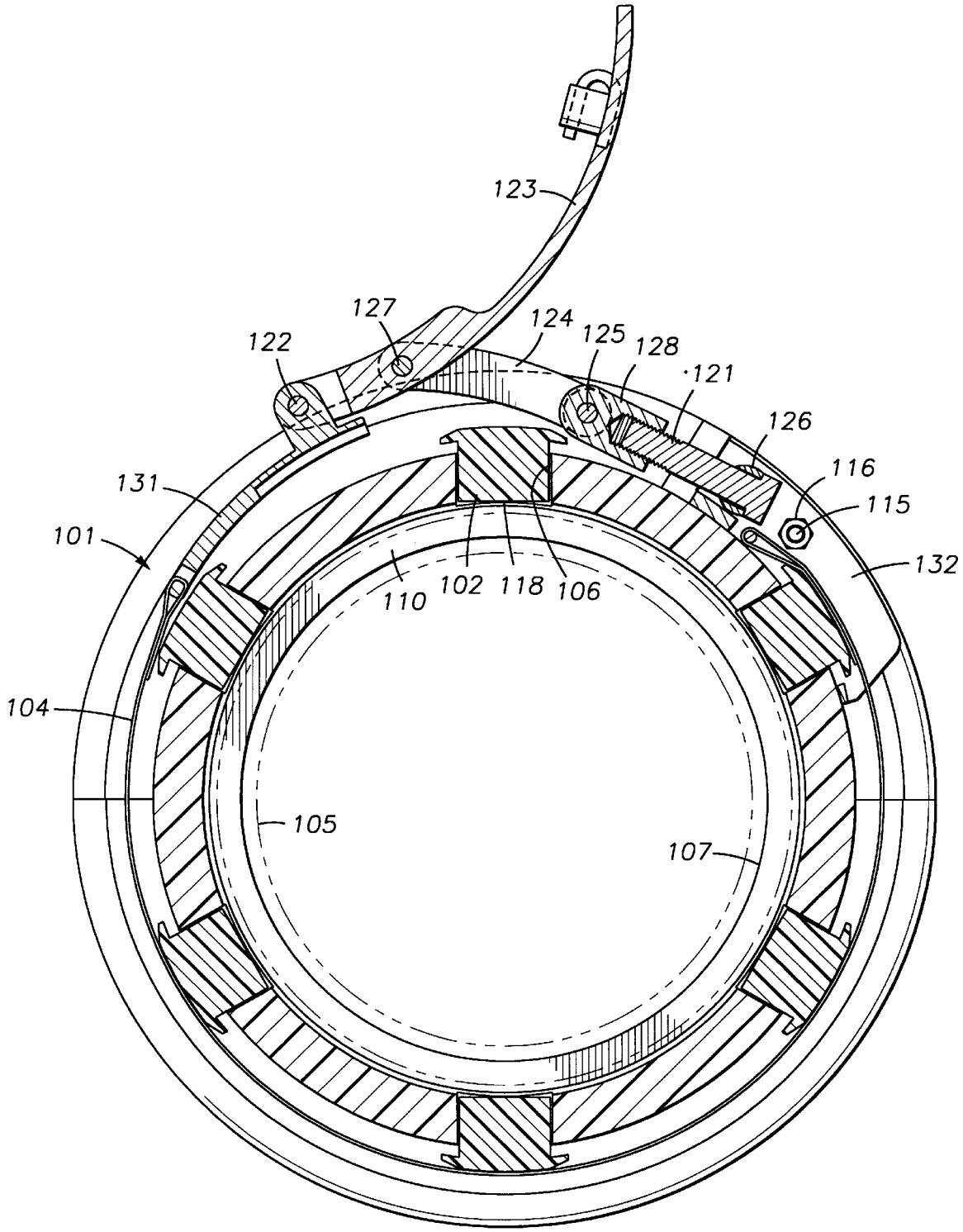
FIG. 15 is an elevation of the new and improved casing thread protector viewed along the axis of pipe to be protected.

Turning now to a discussion of how the four main components of the improved device fit together, reference is made to FIG. 15. In FIG. 15, thread engagement pads 102 are shown inserted into their respective openings 106 and band 104 is shown attached to each of band plates 131 and 132 of clamp mechanism 103. In this figure, clamp mechanism 103 has been actuated to the open position wherein very little tension is applied by said mechanism on band 104, which translates into very little pressure being applied on thread engagement pads 102, allowing said pads a certain degree of movement through their respective openings 106 through which they are inserted. This movement in turn allows thread engagement pads 102 to move into body 101 to allow for the insertion of a pipe 105 through bore 107. Once inserted through bore 107, the forward movement of pipe 105 is limited by flange 110 which serves to position pipe 105 in body 101 of the improved device. It is to be understood that actuation of clamp mechanism 103, either to the open or closed position, affects the separation between band 104 and the thread engagement pads 102, which in turn affects the separation between the individual faces 118 of thread engagement pads 102 and the threads of pipe 105.

Figure 16:
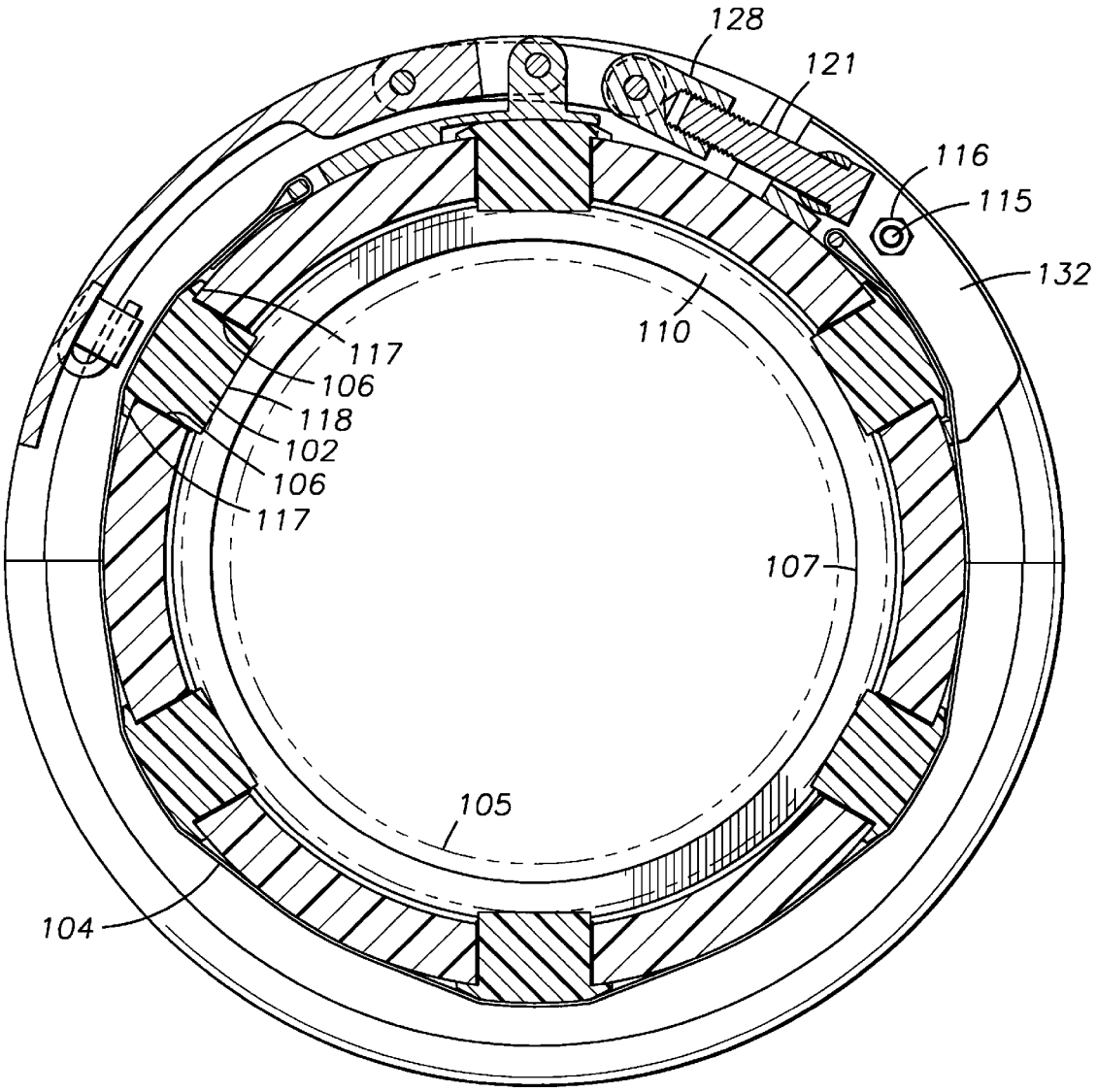
FIG. 16 is an unsectioned view of the new and improved casing thread protector similar to FIG. 15 in the alternate position, open to release pipe.

In FIG. 16, clamp mechanism 103 has been actuated to the closed position wherein the tension on band 104 is increased, forcing thread engagement pads 102 into their respective openings 106, and decreasing the diameter of bore 107 of the improved device. In the preferred embodiment of the improved device, clamp mechanism 103 is, at least in part, embedded in channel 111 of body 101 and the thread engagement pads 102 are restricted in their forward movement through openings 106 by pipe 105 which is inserted through bore 107. Furthermore, thread engagement pads 102 are ultimately restricted in their forward movement through openings 106 by flanges 117 which are wider than openings 106 in body 101 of the improved device. Once radial pressure is applied on the thread engagement pads 102 by band 104 through the application of the tensioning force created by the closure of clamp mechanism 103, the individual faces 118 of the thread engagement pads are brought into contact with the threads of pipe 105 which is inserted through bore 107, isolating said threads from any contact with the improved device and achieving a higher unit loading force, which in turns provides for a firmer grip on the threads of pipe 105, and added protection to said threads due to their isolation from the body of the improved device. The tension in the clamp mechanism 103 is controlled by tensioning bolt 121 which connects band plate 132 to housing 128. Rotating the tensioning bolt 121 in either a clockwise or counterclockwise direction adjusts the tension in band 104 which in turn adjusts the pressure applied by band 104 on thread engagement pads 102, whereby increased tension in said band leads to a greater application of pressure on thread engagement pads 102, leading to a firmer grip on the male threads of well pipe 105 when said pipe is inserted into bore 107 of the improved device, and vice versa.

Figure 17:
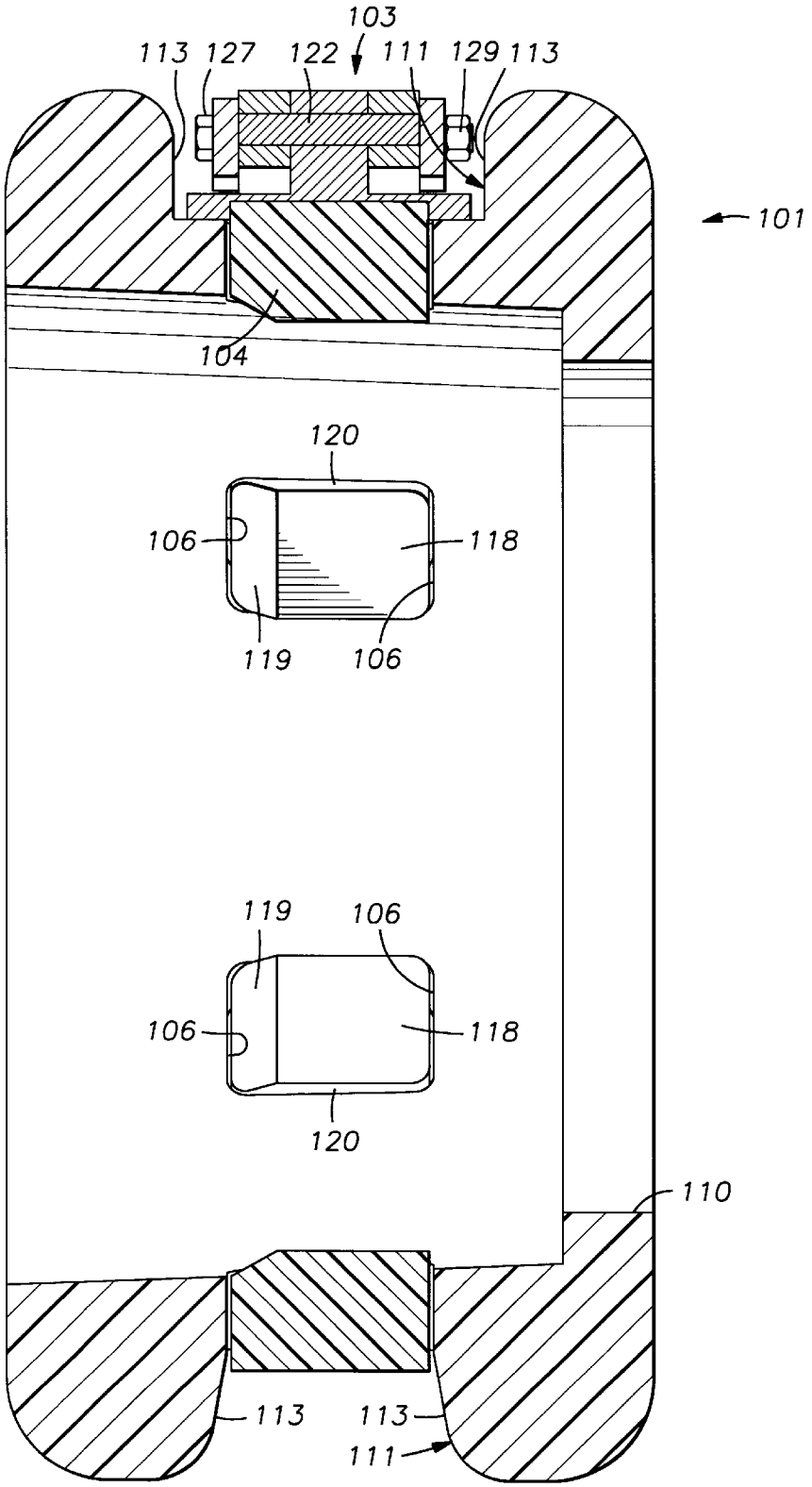
FIG. 17 is a sectioned side view of the new and improved casing thread protector.

FIG. 17 is a cross sectional side view of the preferred embodiment of the improved device, showing channel 111 in body 101 and channel walls 113, inside which band 104 and clamp mechanism 103 are placed, and two thread engagement pads 102 which are shown inserted into their respective openings 106. Notches 119 of the preferred embodiment of the improved device are also shown which provide a slanted plane to facilitate the entry of a tubular good into bore 107 by initially providing a larger clearance for said tubular good as it enters said bore, which clearance is diminished as said tubular good is guided into bore 107 and comes to rest against flange 110. Two faces 118 of the two thread engagement pads 102 of the improved device are also shown, which engage the threads of tubular goods sought to be protected when clamp 103 is actuated into the closed position, and thereby isolate said threads from contact with the body 101 of the improved device.

Figure 18:
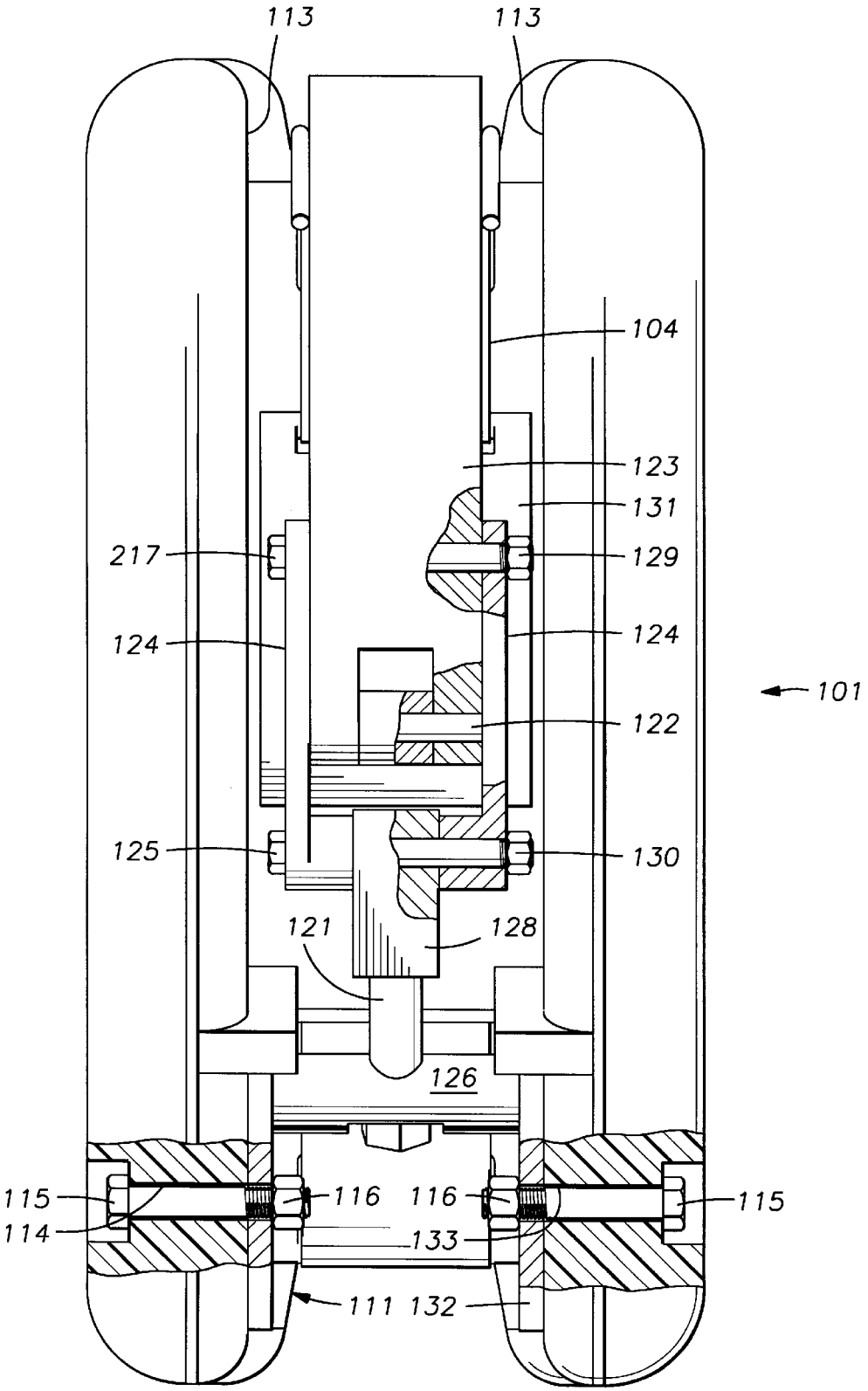
FIG. 18 is a partially sectioned side view of the new and improved casing thread protector.

FIG. 18 is a partially sectioned side view of the preferred embodiment of the improved device, showing channel 111 in body 101 and channel walls 113 inside which the clamp mechanism 103 and band 104 are, at least in part, embedded. This figure further shows how band plate 132 is connected to body 101, wherein the two bolts 115 are initially inserted through their respective holes 114 in body 101 of the improved device and subsequently through the aligned holes 133 of band plate 132. Two nuts 116 are also shown which receive their respective bolts 115 to secure band plate 132 to body 101 of the improved device. Further shown in this figure are bolt 125 attaching links 124 to housing 128 and its respective nut 130, bolt 127 attaching clamp lever 123 to links 124 and its respective nut 129, and pivot pin 122 attaching clamp lever 123 to band plate 131. Finally, tensioning bolt 121 is shown inserted through pivoting terminal 126 of the improved device and screwed into housing 128 which is connected to clamp mechanism 103 by bolt 125, which bolt is secured by nut 130.

From the foregoing, it will be seen that this improved device is one well adapted to attain all of the ends and objects hereinabove set forth, together with other advantages which are obvious and which are inherent to the new and improved casing thread protector.

It will be understood that certain features and subcombinations are of utility and may be employed without reference to other features and subcombinations. This is contemplated by and is within the scope of the claims.

As many possible embodiments may be made of the protector of this invention without departing from the scope thereof, it is to be understood that all matters herein set forth or shown in the accompanying drawings is to be interpreted as illustrative and not in a limiting sense.

The improved invention having been described, we claim:

1. A thread protector for use on pipe to protect male threads, said protector comprising:

a generally cylindrical body of elastomer with open ends, an inner face, an outer face, and a plurality of openings spaced about the body member, each said opening extending from the outer face to the inner face of said body member;

a band and clamp means mounted about the outer face of the cylindrical body, said band and clamp means arranged to actuate between an open and a closed position;

said band situated, at least in part, in and removable from a channel defined about the outer face of said body member;

a plurality of discrete thread engagement pads, each mounted within each of said openings in said body member so as to decrease the diameter of said body member's bore, wherein said body of each said thread engagement pad is substantially that of a rectangular block configuration; and wherein the portion of the thread engagement pad which comes into contact with the threads on the tubular good to be protected is of the same length and width of the body of said thread engagement pad.

2. The thread protector of claim 1, wherein:

said clamp includes a flexible band placed around the outer face of said body member.

3. The thread protector of claim 1, further including:

a flange integrally formed at one end of the cylindrical body member against which the pipe being protected may rest when said thread protector is in use.

4. The thread protector of claim 1, wherein:

said thread engagement pads are replaceable.

5. The thread protector of claim 1, wherein:

said band is removable from around said body member and replaceable.

6. The thread protector of claim 1, wherein a notch is cut out of a side of the a portion of said thread engagement pad which comes into contact with said the threads on the tubular good to be protected, forming a trapezoidal configuration with two sets of right angles, wherein said notch is closest to the edge of the inner face that receives the tubular good.

7. The thread protector of claim 6, wherein an additional notch is cut out on the opposite end of the first notch, forming a trapezoidal configuration.

8. A thread protector for use on pipe to protect male threads, said protector comprising:

a generally cylindrical body of elastomer with open ends, an inner face, an outer face, and a plurality of openings spaced about the body member, each said opening extending from the outer face to the inner face of said body member;

a band and clamp means mounted about the outer face of the cylindrical body, said band and clamp means arranged to actuate between an open and a closed position;

said band situated, at least in part, in and removable from a channel defined about the outer face of said body member;

a plurality of discrete thread engagement pads, each mounted within each of said openings in said body member so as to decrease the diameter of said body member's bore, wherein said body of each said thread engagement pad is substantially that of a rectangular block configuration; and wherein a notch is cut out of a side of a portion of said thread engagement pad which comes into contact with the threads on the tubular good to be protected, forming a trapezoidal configuration with two sets of right angles, wherein said notch is closest to the edge of said inner face that receives the tubular good.

9. The thread protector of claim 8, wherein:

said clamp includes a flexible band placed around the outer face of said body member.

10. The thread protector of claim 8, further including:

a flange integrally formed at one end of the cylindrical body member against which the pipe being protected may rest when said thread protector is in use.

11. The thread protector of claim 8, wherein:

said thread engagement pads are replaceable.

12. The thread protector of claim 8, wherein:

said band is removable from around said body member and replaceable.

13. The thread protector of claim 8, wherein a notch is cut out of a side of the a portion of said thread engagement pad which comes into contact with said the threads on the tubular good to be protected, forming a trapezoidal configuration with two sets of right angles, wherein said notch is closest to the edge of the inner face that receives the tubular good.

14. The tread protector of claim 8, wherein the portion of the thread engagement pad which comes into contact with the threads on the tubular good to be protected is of the same length and width of the body of said thread engagement pad.

15. The thread protector of claim 8, wherein an additional notch is cut out on the opposite end of the first notch, forming a trapezoidal configuration.

* * * * *